US009086073B2

(12) United States Patent
Iyer et al.

(10) Patent No.: US 9,086,073 B2
(45) Date of Patent: Jul. 21, 2015

(54) BLOWER ASSEMBLY

(75) Inventors: Jayanthi R. Iyer, Northville, MI (US); Eric Keith Haupt, Livonia, MI (US); Dennis Anthony Vermette, Westland, MI (US)

(73) Assignee: Halla Visteon Climate Control Corporation, Daejeon-si (KR)

( * ) Notice: Subject to any disclaimer, the term of this patent is extended or adjusted under 35 U.S.C. 154(b) by 750 days.

(21) Appl. No.: 13/370,468

(22) Filed: Feb. 10, 2012

(65) Prior Publication Data

US 2013/0209245 A1 Aug. 15, 2013

(51) Int. Cl.

| | |
|---|---|
| ***F04D 29/28*** | (2006.01) |
| ***F04D 29/42*** | (2006.01) |
| ***F04D 25/08*** | (2006.01) |
| ***F04D 29/16*** | (2006.01) |

(52) U.S. Cl.

CPC ..... *F04D 25/08* (2013.01); *F04D 29/162* (2013.01); *F04D 29/282* (2013.01); *F04D 29/4213* (2013.01); *F04D 29/4226* (2013.01)

(58) Field of Classification Search

CPC ..... F04D 29/2216; F04D 29/2266; F04D 29/282; F04D 29/4213; F04D 29/4226; F04D 29/162

USPC ..... 416/78, 182, 183, 185, 186 R, 187, 188; 415/204–207, 208.1–208.5, 415/209.1–209.4, 210.1, 211.1, 211.2, 415/212.1–219.1, 220–228, 224.5, 225–228

See application file for complete search history.

(56) References Cited

U.S. PATENT DOCUMENTS

| | | | | |
|---|---|---|---|---|
| 2,628,419 | A * | 2/1953 | Wilken | 29/889.4 |
| 2,961,152 | A | 11/1960 | Douglas et al. | |
| 3,231,177 | A * | 1/1966 | Williams et al. | 416/178 |
| 3,246,834 | A * | 4/1966 | Swenson | 415/200 |
| 3,306,528 | A * | 2/1967 | Eck | 415/116 |
| 5,281,092 | A * | 1/1994 | Sullivan | 415/206 |
| 6,491,502 | B2 | 12/2002 | Hunt | |
| 6,506,023 | B1 * | 1/2003 | Chien et al. | 416/186 R |
| 6,599,085 | B2 | 7/2003 | Nadeau et al. | |
| 6,604,906 | B2 | 8/2003 | Ozeki et al. | |
| 6,960,059 | B2 | 11/2005 | Chang et al. | |
| 6,971,846 | B2 | 12/2005 | Ochiai et al. | |
| 7,108,478 | B2 | 9/2006 | Hancock | |
| 7,435,051 | B2 | 10/2008 | Obinelo et al. | |
| 7,549,842 | B2 | 6/2009 | Hanson et al. | |
| 7,591,633 | B2 | 9/2009 | Hancock | |
| 8,033,783 | B2 | 10/2011 | Ishikawa et al. | |
| 2008/0232958 | A1 | 9/2008 | Weyandt | |
| 2011/0250060 | A1 | 10/2011 | Tanaka et al. | |

* cited by examiner

*Primary Examiner* — Ninh H Nguyen

(74) *Attorney, Agent, or Firm* — Fraser Clemens Martin & Miller LLC; James D. Miller

(57) ABSTRACT

A blower assembly for use in a vehicle is disclosed, wherein the blower assembly includes a housing and a fan wheel disposed in the housing. A scroll duct formed in the housing axially and radially expands from a scroll cutoff towards an air outlet. The fan wheel includes a hub, concentrically arranged inner and outer annular rings, and an array of spaced apart blades extending between the hub and the annular rings.

17 Claims, 6 Drawing Sheets

BLOWER ASSEMBLY

FIELD OF THE INVENTION

The invention relates to a blower assembly and more particularly to a blower assembly which optimizes efficiency and minimizes noise and vibration during an operation thereof.

BACKGROUND OF THE INVENTION

Centrifugal fans or blowers are commonly used for directing a forced flow of air through an air duct. In a typical blower assembly, air is drawn into a housing through an air inlet and discharged from the housing through an air outlet. Blower assemblies typically include an electrically driven fan wheel that rotates in a predetermined direction in the housing. The fan wheel includes one or more curved blades, which draw the air into the fan wheel axially along an axis of rotation and discharge the air radially outwardly therefrom.

Typically, in climate control applications such as heating, ventilating, and air conditioning (HVAC) systems of a vehicle, the centrifugal blowers are required to operate effectively and efficiently over a range of operating conditions of the vehicle. However, current centrifugal blowers consume significant electrical energy which negatively affects a fuel economy of the vehicle. Further, during high load operating conditions of the vehicle, energy consumption of the HVAC system generally accounts for a significant portion of the available electrical energy of the vehicle. Thus, minimizing an electrical load of the centrifugal blower is critical to improving an overall efficiency of the vehicle.

Current centrifugal blowers also produce inadequate air flow during extreme driving conditions for a desired customer comfort level. As such, vehicle manufactures are demanding an increase in a capacity of the centrifugal blower to meet the desired customer comfort level without increasing a package size thereof.

Accordingly, it would be desirable to produce a blower assembly that includes a housing and a fan wheel for rotating a volume of air entering the blower assembly, wherein a cost, a package size, and a complexity thereof are minimized and an efficiency thereof is maximized.

SUMMARY OF THE INVENTION

In concordance and agreement with the present invention, a blower assembly that includes a housing and a fan wheel for rotating a volume of air entering the blower assembly, wherein a cost, an airflow restriction, and a complexity thereof are minimized and an efficiency thereof is maximized, has surprisingly been discovered.

In one embodiment, a blower assembly comprises: a housing including a fluid inlet and a spaced apart fluid outlet; and a fan wheel disposed in the housing, the fan wheel including a hub, an inner ring axially spaced apart from the hub in a direction substantially parallel to an axis of rotation of the fan wheel, an outer ring radially outwardly spaced apart from the inner ring, and a plurality of outer blades extending substantially parallel to the axis of rotation of the fan wheel, wherein a first end of at least one of the outer blades is coupled to the hub and a second end of the at least one of the outer blades is coupled to the inner and the outer rings.

In another embodiment, a blower assembly comprises: a housing including a fluid inlet and a fluid outlet formed therein; and a fan wheel disposed in the housing, wherein an inner surface of the housing and an outer peripheral surface of the fan wheel form a scroll duct to receive a flow of fluid therein, wherein the scroll duct expands in an axial direction and a radial direction from a scroll cutoff generally defined as a location where a cross-sectional area of the scroll duct is minimized toward the fluid outlet, a rate of expansion in the radial direction is greater than a rate of expansion in the axial direction from the scroll cutoff to the fluid outlet.

In another embodiment, a blower assembly comprises: a housing including a fluid inlet and a spaced apart fluid outlet; and a fan wheel disposed in the housing, the fan wheel including a hub, an inner ring axially spaced apart from the hub in a direction substantially parallel to an axis of rotation of the fan wheel, an outer ring radially outwardly spaced apart from the inner ring, and a plurality of outer blades extending substantially parallel to the axis of rotation of the fan wheel, wherein a first end of at least one of the outer blades is coupled to the hub and a second end of the at least one of the outer blades is coupled to the inner and the outer rings, and wherein an inner surface of the housing and an outer peripheral surface of the fan wheel form a scroll duct to receive a flow of fluid therein, wherein the scroll duct expands in an axial direction and a radial direction from a scroll cutoff generally defined as a location where a cross-sectional area of the scroll duct is minimized toward the fluid outlet.

DESCRIPTION OF THE DRAWINGS

The above, as well as other objects and advantages of the invention, will become readily apparent to those skilled in the art from reading the following detailed description of a preferred embodiment of the invention when considered in the light of the accompanying drawings in which.

DETAILED DESCRIPTION OF EXEMPLARY EMBODIMENTS OF THE INVENTION

Figure 1:
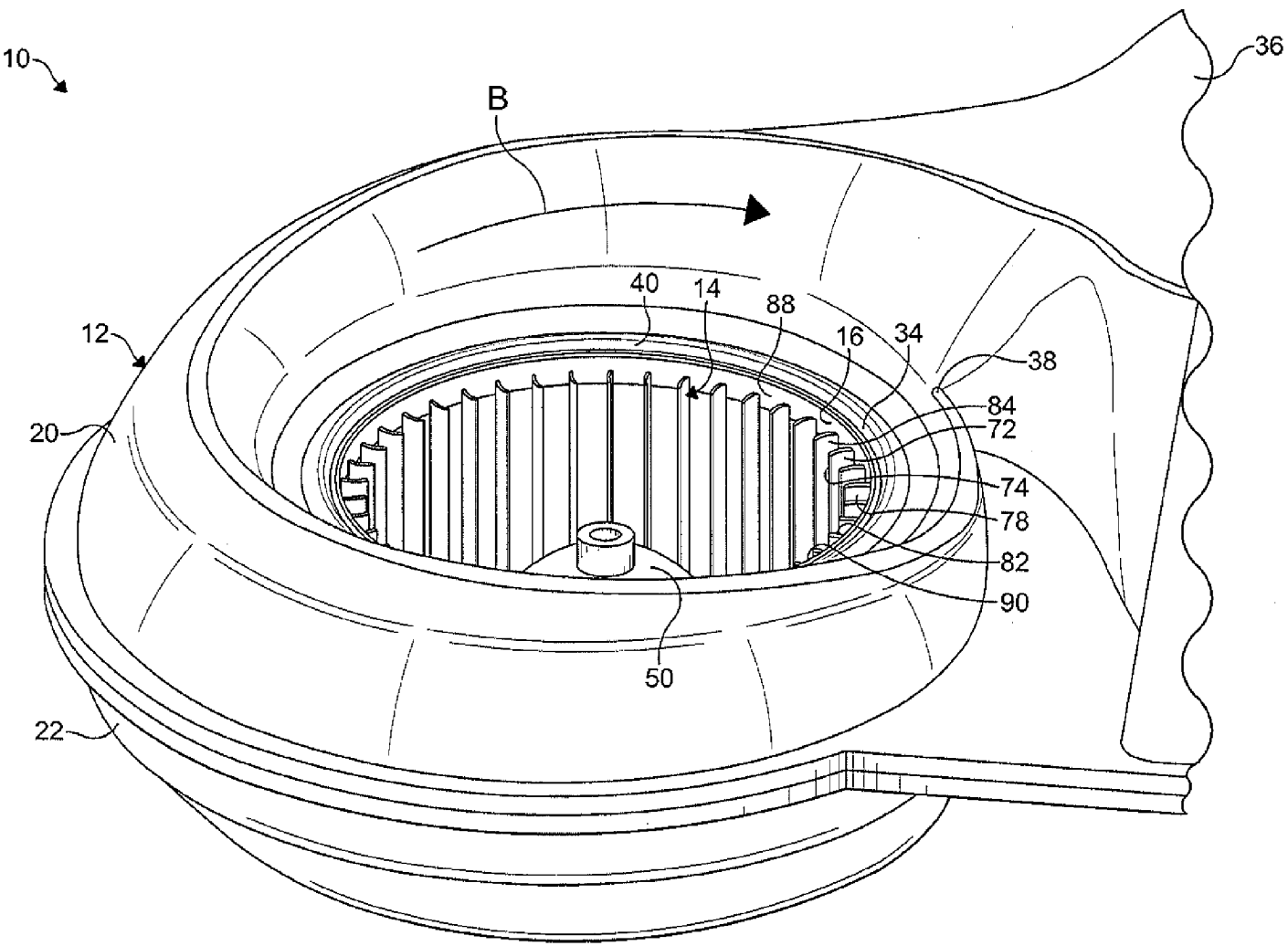
FIG. 1 is a fragmentary top perspective view of a blower assembly in accordance with an embodiment of the invention.
Figure 2:
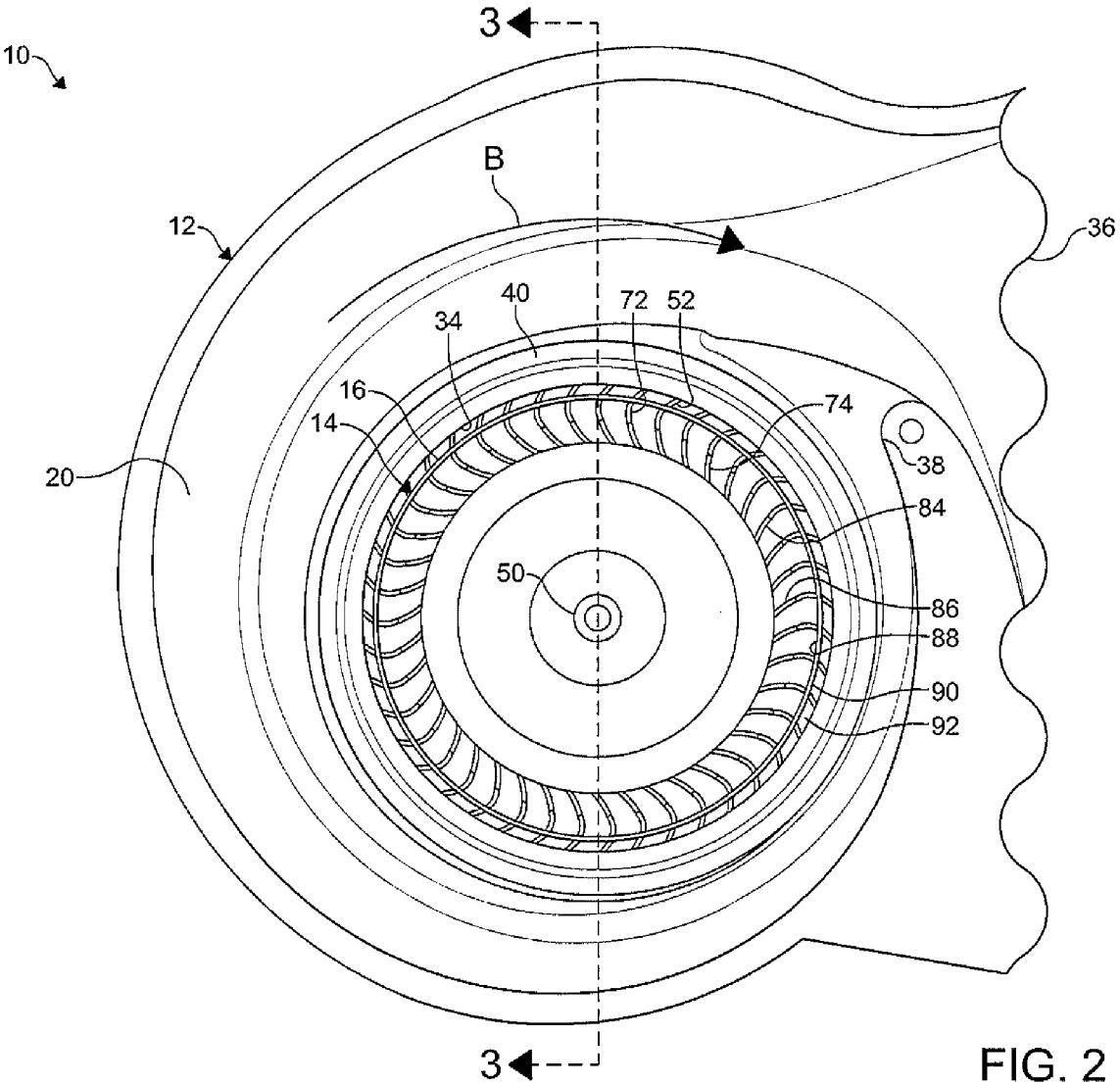
FIG. 2 is a top plan view of the blower assembly illustrated in FIG. 1.

The following detailed description and appended drawings describe and illustrate various exemplary embodiments of the invention. The description and drawings serve to enable one skilled in the art to make and use the invention, and are not intended to limit the scope of the invention in any manner.

FIGS. 1-4 show a blower assembly 10 according to the present invention. The blower assembly 10 includes a housing 12, a centrifugal fan wheel 14 having concentrically arranged inner and outer annular rings 16, 18, and a motor (not shown) for causing a rotation of the fan wheel 14. The blower assembly 10 is used for an air conditioning unit of a vehicle (not shown). It is understood that the blower assembly 10 can be used in other applications as desired. Although the housing 12 and the fan wheel 14 shown are formed from plastic, it is understood that the housing 12 and fan wheel 14 can be formed from other materials as desired.

In certain embodiments, the housing 12 includes a first housing section 20 and a second housing section 22. The first housing section 20 and the second housing section 22 are joined together and cooperate to substantially enclose the fan wheel 14. An inner peripheral surface 26 of the first housing section 20 and an inner peripheral surface 28 of the second housing section 22 form an inner surface 24 of the housing 12. The inner surface 24 of the housing 12 and an outer peripheral surface 30 of the fan wheel 14 define a scroll duct 32. The scroll duct 32 permits a flow of air received by the fan wheel 14 therethrough. An axial air inlet 34 is formed in the housing 12 to facilitate the flow of air into the fan wheel 14 and a tangential air outlet 36 (shown in FIG. 1) is formed in the housing 12 to facilitate the flow of air from the scroll duct 32.

Figure 3:
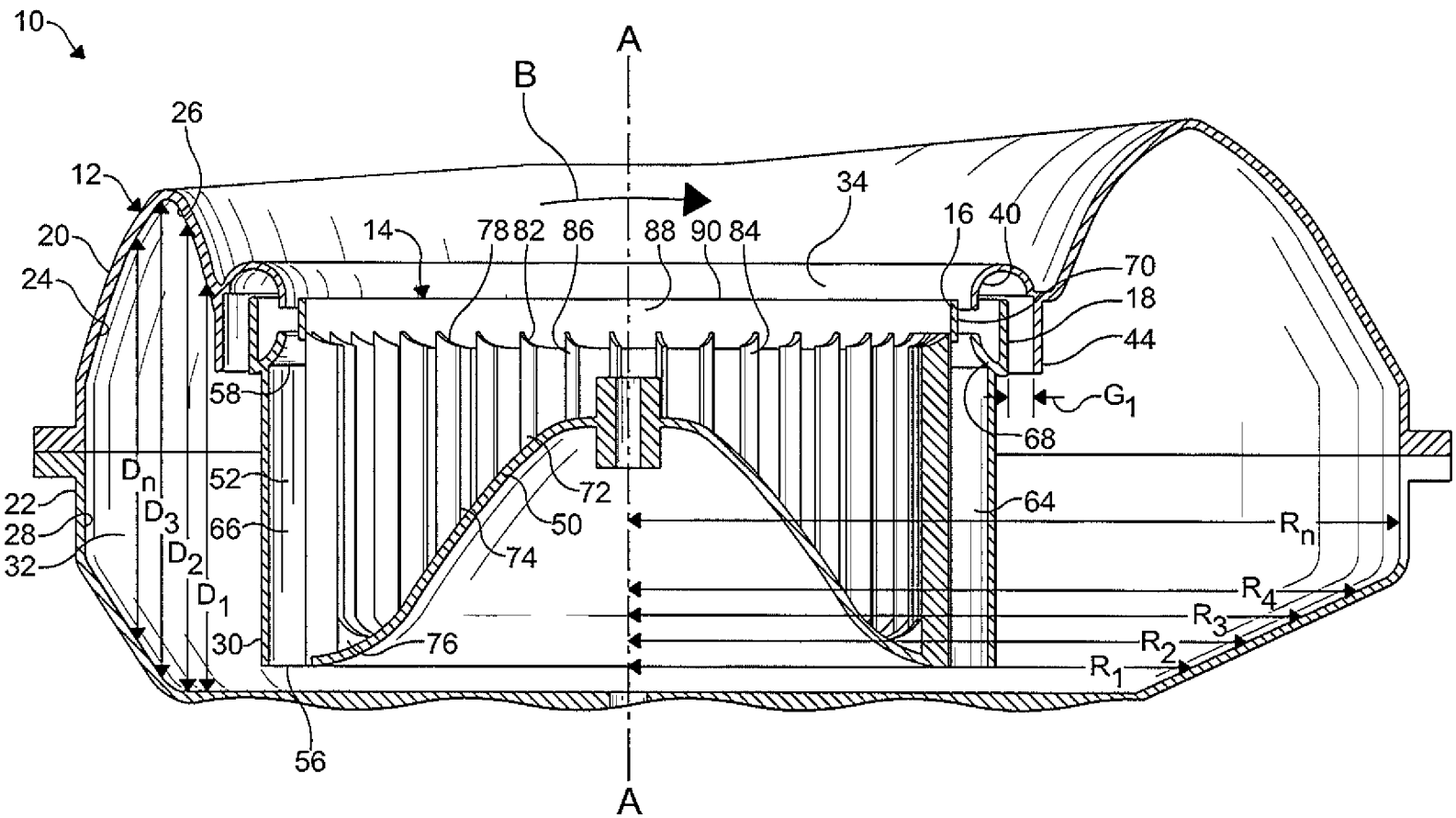
FIG. 3 is a fragmentary, cross-sectional elevational view of the blower assembly illustrated in FIGS. 1-2 taken along line 3-3 of FIG. 2, showing a fan wheel including a hub, inner and outer annular rings, and inner and outer blades extending between the hub and at least one of the annular rings, wherein an edge of the inner blades is offset from an edge of the inner annular ring.
Figure 4:
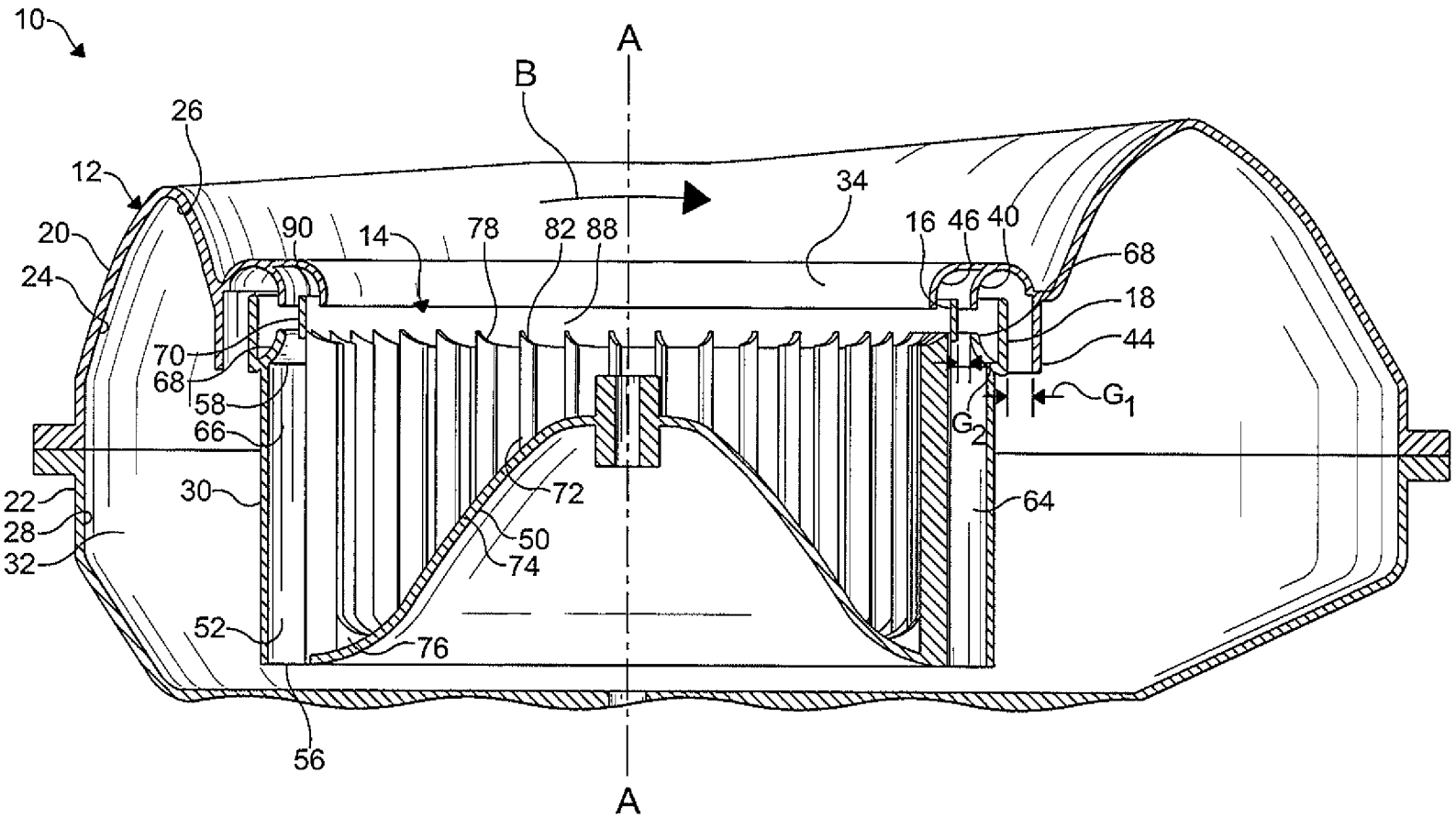
FIG. 4 is a fragmentary, cross-sectional elevational view of the blower assembly showing an alternate housing having the fan wheel of FIG. 3 disposed therein.
Figure 5:
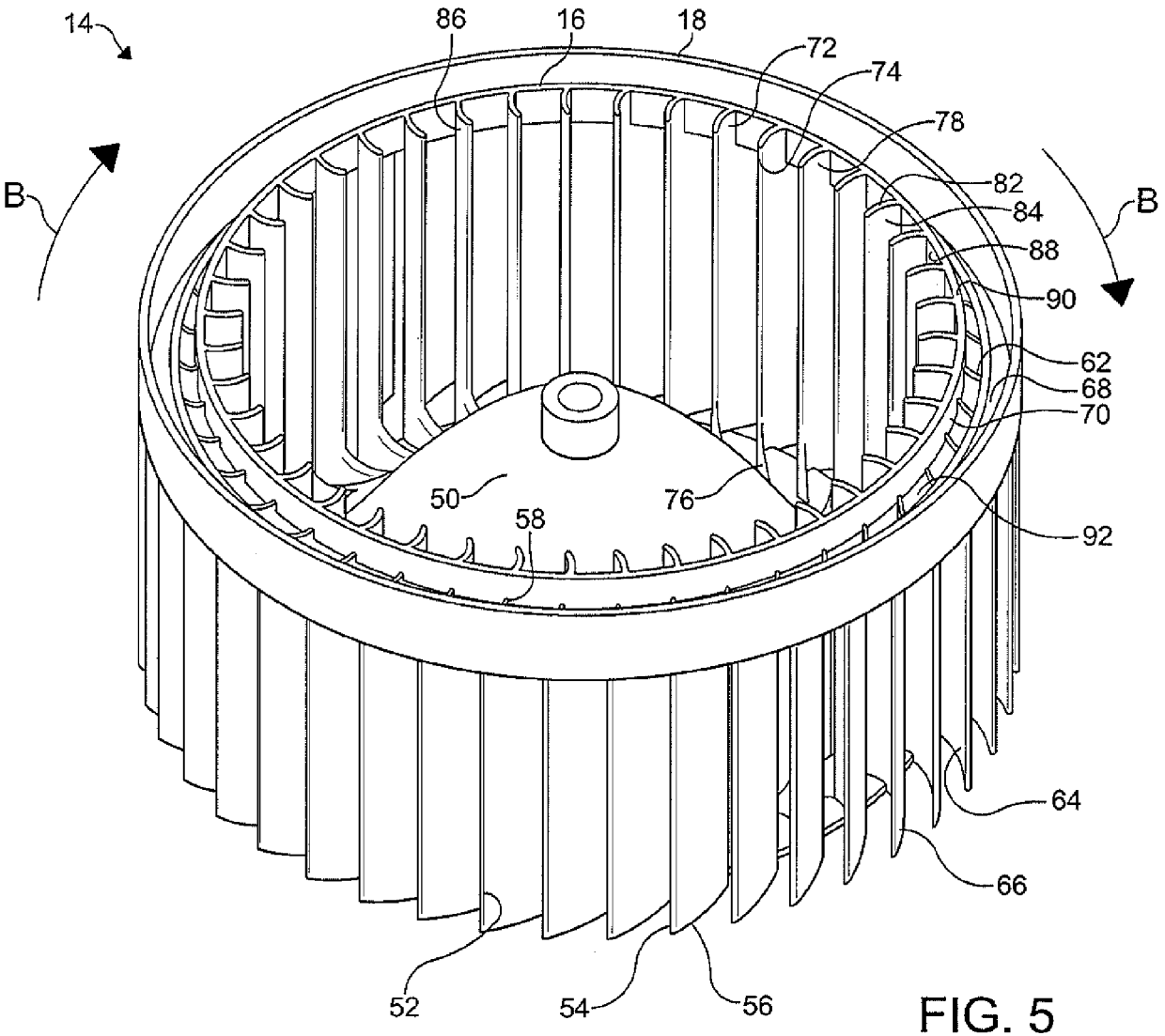
FIG. 5 is a top perspective view of an alternate fan wheel showing the edge of the inner blades extending to the edge of the inner annular ring.
Figure 6:
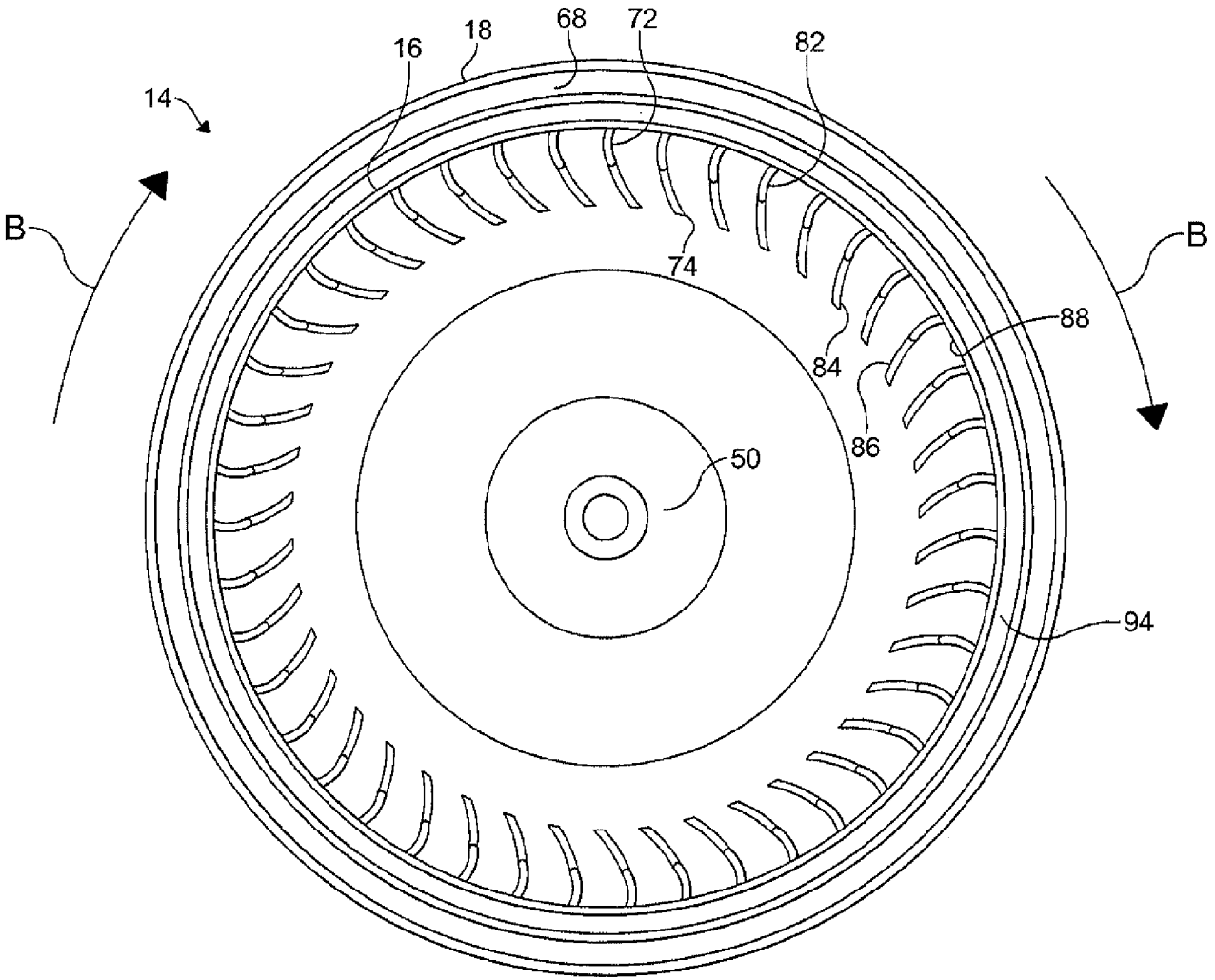
FIG. 6 is a top plan view of another alternate fan wheel showing an annular skirt portion extending between the inner annular ring and the outer annular ring to close openings formed between the outer blades.

As shown in FIGS. 3-4, the scroll duct 32 has a generally D-shaped cross-sectional area. The inner surface 24 of the scroll duct 32 is defined by variable distances $D_1$, $D_2$, $D_3$, . . . $D_n$ (shown in FIG. 3) measured in an axial direction of the fan wheel 14 between the inner peripheral surface 26 of the first housing section 20 and the inner peripheral surface 28 of the second housing section 22. The inner surface 24 of the scroll duct 32 is further defined by variable radii $R_1$, $R_2$, $R_3$, $R_4$, . . . $R_n$ (shown in FIG. 3) measured in a radial direction of the fan wheel 14 between an axis of rotation A of the fan wheel 14 and the inner peripheral surface 26 of the first housing section 20 and the inner peripheral surface 28 of the second housing section 22. As shown, the scroll duct 32 is gradually expanded in the axial direction of the fan wheel 14, as well as in the radial direction of the fan wheel 14 from a scroll cutoff 38 (shown in FIG. 2 as the narrowest point of the scroll duct 32 or a location where the cross-sectional area of the scroll duct 32 is minimized) toward the air outlet 36. In other words, the cross-sectional area of the scroll duct 32 generally increases from the scroll cutoff 38 toward the air outlet 36. In certain embodiments, a rate of change of the distances $D_1$, $D_2$, $D_3$, . . . $D_n$ (axial expansion) is different from a rate of change of the radii $R_1$, $R_2$, $R_3$, $R_4$, ... $R_n$ (radial expansion) from the scroll cutoff 38 toward the air outlet 36. In a non-limiting example, the rate of radial expansion of the scroll duct 32 is greater than the rate of axial expansion of the scroll duct 32 from the scroll cutoff 38 to the air outlet 36. The axial and the radial expansion of the scroll duct 32 from the scroll cutoff 38 to the air outlet 36 allows the fan wheel 14 to convert dynamic head pressure more effectively to obtain a relatively higher static pressure for a given flow rate, thereby improving an efficiency of the blower assembly 10.

As shown in FIGS. 3-4, a first inlet feature 40 is formed on the housing 12 to militate against air in the scroll duct 32 from flowing through a gap $G_1$ formed between the outer annular ring 18 of the fan wheel 14 and an inner wall 44 of the housing 12 and into the air inlet 34. Accordingly, the first inlet feature 40 minimizes a recirculation flow of the air at the air inlet 34. In certain embodiments, the first inlet feature 40 spans the gap $G_1$ and extends between the inner annular ring 16 and the outer annular ring 18 of the fan wheel 14. However, it is understood that the first inlet feature 40 can have any shape and size as desired such as a substantially curved cross-sectional shape, for example.

A second inlet feature 46, shown in FIG. 4, can be integrally or separately formed with the first inlet feature 40 to militate against air in the scroll duct 32 from flowing through a gap $G_2$ formed between the inner annular ring 16 and the outer annular ring 18 of the fan wheel 14 and into the air inlet 34. Accordingly, the second inlet feature 46 further minimizes the recirculation flow of the air at the air inlet 34. In certain embodiments, the second inlet feature 46 spans the gap $G_2$ and extends into an opening defined by the inner annular ring 16 of the fan wheel 14. It is understood, however, that the second inlet feature 46 can have any shape and size as desired such as a substantially curved cross-sectional shape, for example. It is further understood that the inlet features 40, 46 can be formed to circumscribe an entire periphery of the air inlet 34 or any portion of the periphery of the air inlet 34 such as a portion adjacent the scroll cutoff 38 of the housing 12, for example.

As illustrated in FIGS. 3-6, the fan wheel 14 includes the inner and outer annular rings 16, 18, a hub 50, and an annular array of spaced apart outer blades 52. The hub 50 of the fan wheel 14 is connected to a rotation shaft (not shown) of the motor to impart a rotational movement therewith. It is understood that the fan wheel 14 can be caused to rotate by any manual or automatic means as desired. Rotational movement of the fan wheel 14 in a first direction, indicated by arrows B, causes the flow of air received in the air inlet 34 to flow at an increased dynamic pressure in a radially outward direction in respect of the fan wheel 14. A central portion of the hub 50 extends toward the air inlet 34 forming a dome. In the illustrated embodiment, the outer blades 52 are arranged on a periphery of the hub 50 at equal intervals with respect to the axis of rotation A of the fan wheel 14, although other intervals can be used. Additional or fewer outer blades 52 than shown can be employed if desired.

Each of the outer blades 52 includes a substantially linear edge 54 extending from a first end 56 thereof along an entire length of the outer blade 52 to a second end 58 thereof. An edge 62 of the outer blades 52 (shown in FIG. 5) is a curved or rounded edge, although the edge 62 may have other shapes as desired such as linear, for example. Each of the outer blades 52 further includes a first surface 64 and an opposed second surface 66. In certain embodiments, the first surface 64 and the second surface 66 have a substantially concave shape in the direction of rotation B of the fan wheel 14. It is understood that the first surface 64 and the second surface 66 can have any shape as desired such as a substantially convex shape in the direction of rotation of the fan wheel 14 or a substantially planar shape, for example.

The outer blades 52 are positioned on the hub 50 substantially in parallel with the axis of rotation A of the fan wheel 14. As shown, the first end 56 of each of the outer blades 52 is connected to an outer periphery of the hub 50 and the second end 58 of each of the outer blades 52 is connected to a shroud portion 68 of the outer annular ring 18 and an outer peripheral surface 70 of the inner annular ring 16. It is understood that the outer blades 52 can be separately or integrally formed with the hub 50 and the annular rings 16, 18 if desired. The shroud portion 68 shown has a generally annular shape and defines an inner periphery of the outer annular ring 18. The inner annular ring 16 provides support and rigidity to the outer annular ring 18 and the outer blades 52.

The fan wheel 14 may further include an annular array of spaced apart inner blades 72. As shown, the inner blades 72 are integrally formed with the outer blades 52. It is understood, however, that the inner blades 72 can be separately formed from the outer blades 52 if desired. In the illustrated embodiment, the inner blades 72 are arranged on the hub 50 at equal intervals with respect to the axis of rotation A of the fan wheel 14, although other intervals can be used. Additional or fewer inner blades 72 than shown can be employed if desired.

Each of the inner blades 72 includes a substantially linear leading edge 74 extending from a first end 76 thereof along an entire length of the inner blade 72 to a second end 78 thereof. An edge 82 of the inner blades 72 shown is a curved or rounded edge, although the edge 82 may have other shapes as desired such as linear, for example. Each of the inner blades 72 further includes a first surface 84 and an opposed second surface 86. In certain embodiments, the surfaces 84, 86 of the inner blades 72 merge with the respective surfaces 64, 66 of the outer blades 52. In a non-limiting example, the first surface 84 and the second surface 86 have a substantially concave shape in the direction of rotation B of the fan wheel 14. It is understood that the first surface 84 and the second surface 86 can have any shape as desired such as a substantially convex shape in the direction of rotation of the fan wheel 14 or a substantially planar shape, for example.

The inner blades 72 are positioned on the hub 50 substantially in parallel with the axis of rotation A of the fan wheel 14. As shown, the first end 76 of each of the inner blades 72 is connected to the hub 50 and the second end 78 of each of the inner blades 72 is connected to an inner peripheral surface 88 of the inner annular ring 16. It is understood that the inner blades 72 can be separately or integrally formed with the hub 50 and the inner annular ring 16 if desired. In certain embodiments shown in FIGS. 1-4, the edge 82 of the second end 78 of each of the inner blades 72 is offset from an edge 90 of the inner annular ring 16. In other embodiments shown in FIG. 5, the edge 82 of the second end 78 of each of the inner blades 72 extends to the edge 90 of the inner annular ring 16.

Openings 92 formed between the outer blades 52 minimize an accumulation of dynamic pressure at the air inlet 34. In certain embodiments, the openings 92 can be closed by an annular skirt portion 94 (shown in FIG. 6) extending between the inner annular ring 16 and the outer annular ring 18. Closure of the openings 92 separates the flow of air through the air inlet 34 from the flow of air past the scroll cutoff 38 and through the air outlet 36. The separation of the flow of air through the air inlet 34 further minimizes the recirculation flow of the air at the air inlet 34. Accordingly, turbulence and noise produced by interference between the recirculation flow of the air and the flow of the air through the air inlet 34 is also minimized. Minimization of the recirculation flow of the air at the air inlet 34 facilitated by the skirt portion 94 also minimizes the accumulation of dynamic pressure and air within the scroll duct 32.

In use the fan wheel 14 is driven by the motor and is caused to rotate about the axis of rotation A. The rotation of the fan wheel 14 causes the air to flow through the air inlet 34 of the housing 12. The blades 52, 72 cause a change of direction of the air from a substantially axial direction parallel to the axis of rotation A of the fan wheel 14 to a substantially radial direction perpendicular to the axis of rotation A. Accordingly, the air flows axially through the air inlet 34 into the fan wheel 14, and then flows radially outwardly from the fan wheel 14 into the scroll duct 32. Thereafter, the air flows out of the blower assembly 10 through the air outlet 36 to a desired area.

From the foregoing description, one ordinarily skilled in the art can easily ascertain the essential characteristics of this invention and, without departing from the spirit and scope thereof, can make various changes and modifications to the invention to adapt it to various usages and conditions.

The invention claimed is:

1. A blower assembly comprising:

a housing including a fluid inlet and a spaced apart fluid outlet, the housing further including a first inlet feature at least partially circumscribing the fluid inlet; and a fan wheel disposed in the housing, the fan wheel including a hub, an inner ring axially spaced apart from the hub in a direction substantially parallel to an axis of rotation of the fan wheel, an outer ring radially outwardly spaced apart from the inner ring, and a plurality of outer blades extending substantially parallel to the axis of rotation of the fan wheel, wherein a first end of at least one of the outer blades is coupled to the hub and a second end of the at least one of the outer blades is coupled to the inner and the outer rings, wherein the first inlet feature of the housing spans a gap formed between the outer ring of the fan wheel and an inner wall of the housing and extends over the outer ring and between the inner ring and the outer ring.

2. The blower assembly according to claim 1, wherein the fan wheel includes a skirt portion extending between the inner ring and the outer ring to provide a closure to openings formed between the outer blades of the fan wheel.

3. The blower assembly according to claim 1, wherein the fan wheel includes a plurality of inner blades extending substantially parallel to the axis of rotation of the fan wheel, a first end of each of the inner blades coupled to the hub and a second end of each of the inner blades coupled to the inner ring.

4. The blower assembly according to claim 3, wherein the inner blades are integrally formed with the outer blades.

5. The blower assembly according to claim 3, wherein the second end of at least one of the inner blades extends to an edge of the inner ring.

6. The blower assembly according to claim 3, wherein the second end of at least one of the inner blades is offset from an edge of the inner ring.

7. The blower assembly according to claim 1, wherein the housing includes a first housing section and a second housing section.

8. The blower assembly according to claim 7, wherein an inner surface of the housing is at least partially defined by an inner peripheral surface of the first housing section and an inner peripheral surface of the second housing section.

9. The blower assembly according to claim 8, wherein a distance between the inner peripheral surface of the first housing section and the inner peripheral surface of the second housing section is variable.

10. The blower assembly according to claim 9, wherein the distance between the inner peripheral surface of the first housing section and the inner peripheral surface of the second housing section increases from a scroll cutoff generally defined as a location where a cross-sectional area of a scroll duct formed in the housing is minimized to the fluid outlet of the housing.

11. The blower assembly according to claim 8, wherein a radius of the housing measured between the axis of rotation of the fan wheel and the inner surface of the housing is variable.

12. The blower assembly according to claim 11, wherein the radius of the housing measured between the axis of rotation of the fan wheel and the inner surface of the housing increases from a scroll cutoff generally defined as a location where a cross-sectional area of a scroll duct formed in the housing is minimized to the fluid outlet of the housing.

13. The blower assembly according to claim 1, wherein the housing further includes a second inlet feature at least partially circumscribing the fluid inlet, and wherein the second inlet feature spans a second gap formed between the inner ring and the outer ring of the fan wheel and extends into an opening defined by the inner ring of the fan wheel.

14. A blower assembly comprising:

a housing including a fluid inlet and a spaced apart fluid outlet, the housing further including a first inlet feature at least partially circumscribing the fluid inlet; and a fan wheel disposed in the housing, the fan wheel including a hub, an inner ring axially spaced apart from the hub in a direction substantially parallel to an axis of rotation of the fan wheel, an outer ring radially outwardly spaced apart from the inner ring, and a plurality of outer blades extending substantially parallel to the axis of rotation of the fan wheel, a first end of at least one of the outer blades is coupled to the hub and a second end of the at least one of the outer blades is coupled to the inner and the outer rings, wherein an inner surface of the housing and an outer peripheral surface of the fan wheel form a scroll duct to receive a flow of fluid therein, wherein the scroll duct expands in an axial direction and a radial direction from a scroll cutoff generally defined as a location where a cross-sectional area of the scroll duct is minimized toward the fluid outlet, and wherein the first inlet feature of the housing spans a gap formed between the outer ring of the fan wheel and an inner wall of the housing and extends over the outer ring and between the inner ring and the outer ring.

15. The blower assembly according to claim 14, wherein a rate of expansion in the radial direction is greater than a rate of expansion in the axial direction from the scroll cutoff to the fluid outlet.

16. The blower assembly according to claim 14, wherein at least one of a radius of the housing measured between the axis of rotation of the fan wheel and the inner surface of the housing and a distance between an inner peripheral surface of a first housing section of the housing and an inner peripheral surface of a second housing section and is variable.

17. The blower assembly according to claim 14, wherein the housing further includes a second inlet feature at least partially circumscribing the fluid inlet, and wherein the second inlet feature spans a second gap formed between the inner ring and the outer ring of the fan wheel and extends into an opening defined by the inner ring of the fan wheel.

* * * * *